US005590934A

United States Patent [19]

Gibbs

[11] Patent Number: 5,590,934

[45] Date of Patent: Jan. 7, 1997

[54] ADJUSTABLE CHAIR-ARMREST ASSEMBLY

[75] Inventor: Terence E. Gibbs, Grandview, N.Y.

[73] Assignee: Shin Yeh Enterprise Co., Ltd., Taiwan

[21] Appl. No.: 612,316

[22] Filed: Mar. 7, 1996

[51] Int. Cl.[6] ..... A47C 7/54

[52] U.S. Cl. ..... 297/411.38; 297/411.37; 297/411.35

[58] Field of Search ..... 297/411.2, 411.35, 297/411.37, 411.38, 115, 116; 248/118

[56] References Cited

U.S. PATENT DOCUMENTS

| | | | |
|---|---|---|---|
| 3,140,119 | 7/1964 | Offner | 297/411.35 X |
| 4,807,935 | 2/1989 | King | 297/411.38 |
| 4,822,103 | 4/1989 | Stenvall | 297/411.35 |
| 4,961,610 | 10/1990 | Reeder et al. | 297/411.35 |
| 5,415,459 | 5/1995 | Schultz | 297/411.37 |
| 5,439,268 | 8/1995 | Dozsa-Farkas | 297/411.38 X |
| 5,484,187 | 1/1996 | Doerner et al. | 297/411.38 X |

*Primary Examiner*—Milton Nelson, Jr.
*Attorney, Agent, or Firm*—Ladas & Parry

[57] ABSTRACT

An adjustable chair-armrest assembly includes an chair-armrest assembly includes an elongated positioning plate attached to a chair seat, an elongated coupling seat mounted pivotally on the positioning plate and rotatable about a vertical axis, and an elongated tilting seat mounted pivotally on the coupling seat and rotatable about a horizontal axis. An armrest member is mounted movably on the tilting seat and can be moved along the length of the tilting seat. An inclination adjusting device includes a slot element which is secured to the rear end portion of the coupling seat and which has several horizontal slots extending in a direction transverse to the coupling seat, and an engagement having an upper end portion pivoted to the rear end portion of the coupling seat, and a lower end with a projection projecting therefrom into a selected one of the slots of the slot element. A spring biases the projection to engage the selected one of the slots. A pusher member abuts on the engagement member so as to push the projection of the engagement member to engage the selected one of the slots and can be operated to remove from the engagement member so as to permit the front end of the armrest member to be turned upward and downward.

4 Claims, 6 Drawing Sheets

36
353
352
350
35
351
33
310
33
312
313
31
311
46
34
40
310
32
30
31
22
3
220
313
400
401
20
133
22
2
220
21
132
133
131
130
122
13
132
37
123
121
12
122
1
11
55
5
53
51
54
51
50
52
41
411
410
47
43
421
431
45
420
48
44
4
42
422
425
423
430
421
424
443
426
442
44
441
440

ADJUSTABLE CHAIR-ARMREST ASSEMBLY

BACKGROUND OF THE INVENTION

1. Field of the Invention

This invention relates to a chair armrest assembly, more particularly to an adjustable chair armrest assembly in which the orientation of the armrest member can be adjusted.

2. Description of the Related Art

Nowadays, in the art, people are more and more fastidious about convenience in use of chairs. Some conventional chair armrests can be adjusted horizontally and/or vertically on the chair seats. However, there is a need to rotate an armrest about a horizontal axis and/or a vertical axis on the chair seat, e.g. for a computer chair.

SUMMARY OF THE INVENTION

It is therefore the main object of this invention to provide an adjustable chair-armrest assembly with an armrest member which can be rotated about horizontal and vertical axes on the chair seat.

According to this invention, an adjustable chair-armrest assembly includes an elongated positioning plate attached to a chair seat, an elongated coupling seat mounted pivotally on the positioning plate and rotatable about a vertical axis, and an elongated tilting seat mounted pivotally on the coupling seat and rotatable about a horizontal axis. An armrest member is mounted movably on the tilting seat and can be moved along the length of the tilting seat. An inclination adjusting device includes a slot element which is secured to the rear end portion of the coupling seat and which has several horizontal slots extending in a direction transverse to the coupling seat, and an engagement member having an upper end portion pivoted to the rear end portion of the coupling seat, and a lower end with a projection projecting therefrom into a selected one of the slots of the slot element. A spring biases the projection to engage the selected one of the slots. A pusher member abuts on the engagement member so as to push the projection of the engagement member to engage the selected one of the slots and can be operated to remove from the engagement member so as to permit the front end of the armrest member to be turned upward and downward, thereby moving the projection into another one of the slots and varying the inclination angle of the armrest member.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
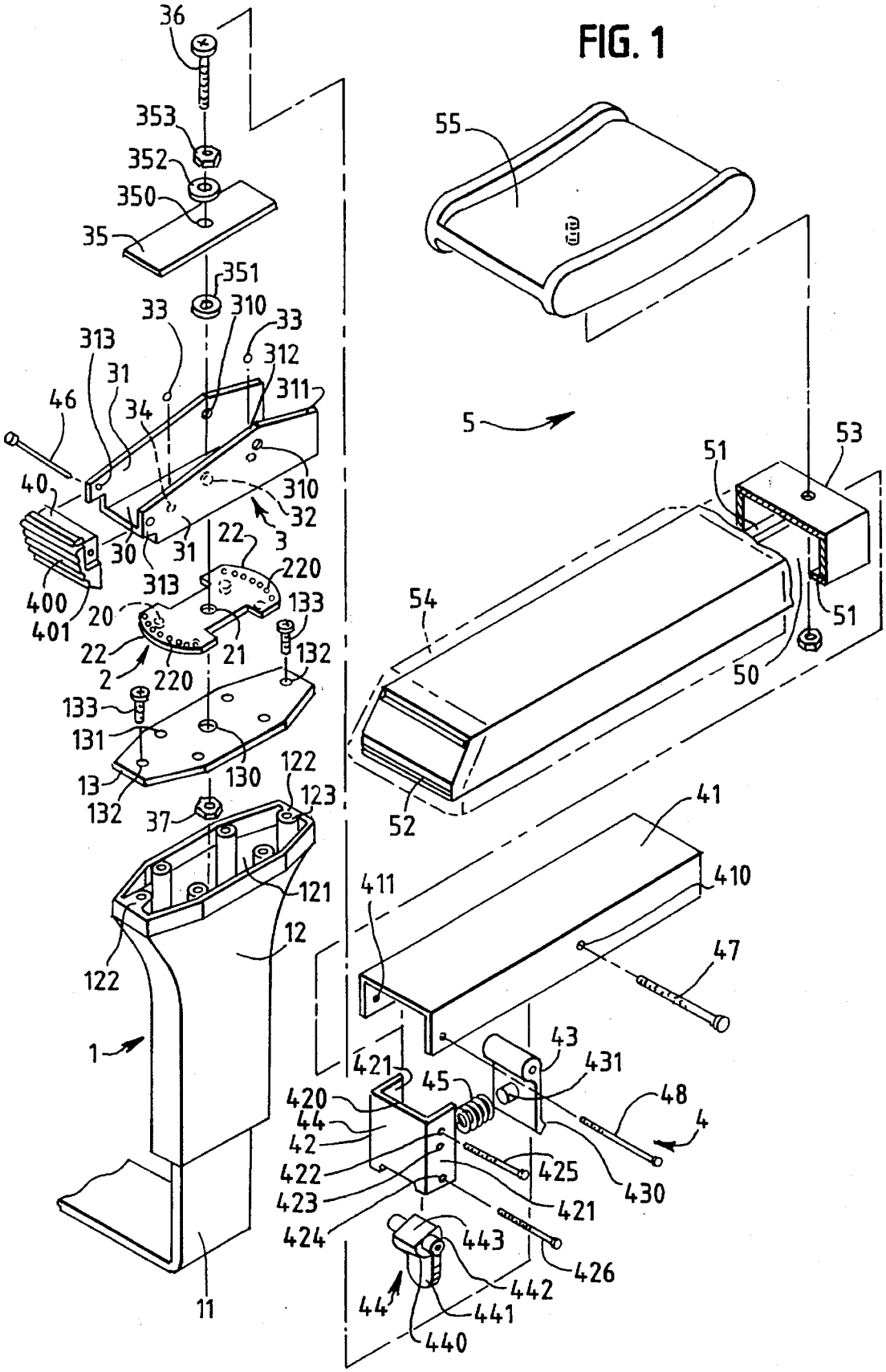
FIG. 1 is an exploded view of an adjustable chair-armrest assembly according to this invention.
Figure 2:
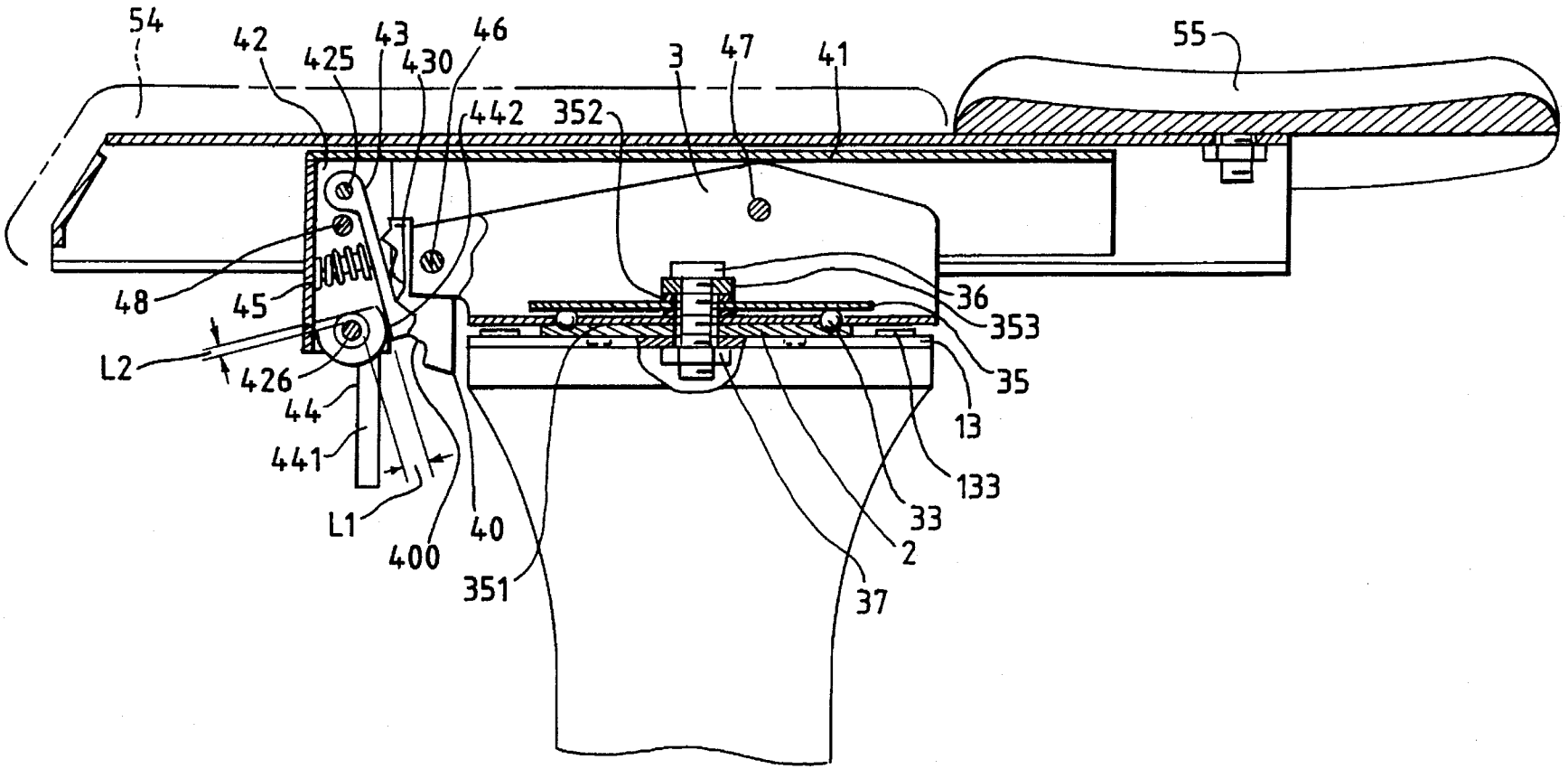
FIG. 2 is a sectional view showing the adjustable chair-armrest assembly of this invention.
Figure 3:
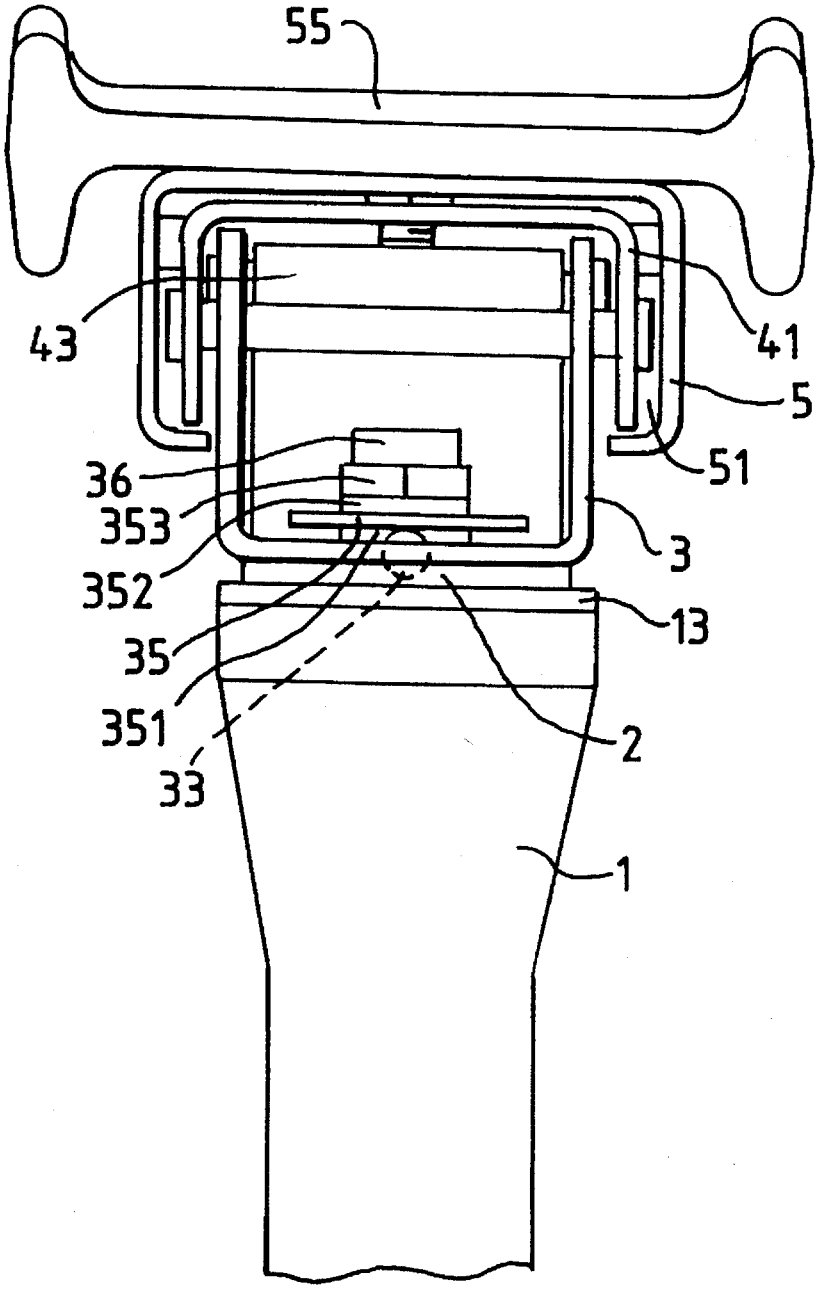
FIG. 3 is a schematic view illustrating how some elements are mounted within an armrest member of the adjustable chair-armrest assembly in accordance with this invention.

Referring to FIGS. 1, 2 and 3, an adjustable chair-armrest assembly of this invention includes an L-shaped support 1, an elongated positioning plate 2, an elongated coupling seat 3, an elongated tilting seat 41, and an armrest member 5.

The support 1 has a lower section 11 fixed on a chair seat (not shown), and an upper section 12 which includes a chamber 121, and two posts 122 that are respectively and integrally formed with two sides of the peripheral wall of the upper section 12 and that respectively have two threaded holes 123 formed in the upper end surfaces of the posts 122. A cover plate 13 has a pivot hole 130 formed therethrough, four positioning holes 131 located around the pivot hole 130, and two fastener holes 132 formed through two end portions of the cover plate 13 so that two bolts 133 extend through the fastener holes 132 to engage the threaded holes 123 of the support 1, so as to fix the cover plate 13 on the support 1.

The positioning plate 2 is generally H-shaped and includes a pivot hole 21 formed through the central portion thereof, and two side portions 22 each of which has several equidistant positioning holes 220 that are all spaced apart from the pivot hole 21 at a predetermined distance.

The coupling seat 3 is constructed in the form of a generally U-shaped plate which has an elongated rectangular bottom wall 30 and two aligned side plates 31. The bottom wall 30 has a pivot hole 32 formed through the middle portion thereof, and two balls 33 which are respectively confined within two ball holes 34 that are formed through the bottom wall 30 and that are located on two sides of the pivot hole 32. Each of the side walls 31 has a pivot hole 310 and an inverted V-shaped top edge which consists of a front side 311 and a rear side 312. A vertical bolt 36 extends through an upper nut 353, an upper washer 352, the pivot hole 350 of a reed spring 35, a lower washer 351, the pivot hole 32 of the coupling seat 3, the pivot hole 21 of the positioning plate 2 and the pivot hole 130 of the cover plate 13 to engage a lower nut 37, in such a manner that four downwardly extending cylindrical projections 20 are respectively inserted into the positioning holes 131 of the cover plate 13, so as to clamp the balls 33 between the reed spring 35 and the positioning plate 2, and so as to bias the balls 33 into selected two of the positioning holes 220 of the positioning plate 2. Accordingly, the positioning plate 2 is fixed on the support 1.

The tilting seat 41 is of an inverted U-shaped cross-section and has a top wall and two side walls each of which is formed with a pivot hole 410. The top wall of the tilting seat 41 abuts on the top edges of the side walls 31 of the coupling seat 3. A horizontal pivot pin 47 extends through the pivot hole 410 of the tilting seat 41 and the pivot holes 310 of the coupling seat 3 so that the tilting seat 41 can swing on the coupling seat 3.

The armrest member 5 has two side walls and a top wall which cooperatively define a chamber 50 under the top wall. Each of the side walls of the armrest member 5 is formed at the lower end with a horizontal rib 51, and a rear end wall 52 is integrally formed with the side walls and the top wall of the armrest member 5, so as to confine the tilting seat 41 between the side walls of the armrest member 5, in such a manner that the planar top wall of the armrest member 5 is in frictional contact with the planar top wall of the tilting seat 41, and that the armrest member 5 can move forward and rearward along the length of the tilting seat 4. The armrest member 5 further has an open end 53 near which a wrist receiving element 55 is secured to the armrest member 5 for placement of a wrist of a user thereon. As illustrated in FIG. 1, an armrest sleeve 54 (shown by the phantom lines) can be sleeved on the rear section of the armrest member 5 for placement of the arm of the user thereon.

An inclination adjusting device 4 includes a slot element 40, a generally U-shaped mounting member 42, an engagement member 43, a pusher member 44, a coiled compression spring 45, and two horizontal pivot pins 46 and 48.

The pivot pin 46 extends through the pivot holes 313 of the side walls 31 of the coupling seat 3 and the holes of the slot element 40. The slot element 40 has a rearward surface formed with several horizontal slots 400, and a frontward surface formed with an open-ended horizontal slot 401 within which the rear end of the bottom wall 30 of the coupling seat 3 is engaged so as to secure the slot element 40 to the coupling seat 3.

The generally U-shaped mounting member 42 has a vertical back wall 420 perpendicular to the side walls of the tilting seat 41, and two vertical side walls 421 respectively and integrally formed with two sides of the back wall 420 and having top sides abutting on the top wall of the tilting seat 41. Each of the side walls of the tilting seat 41 and the mounting member 42 has a pivot hole 411, 423 formed therethrough. The horizontal pivot pin 48 extends through the pivot holes 411, 423 of the tilting seat 41 and the mounting member 42 so as to secure the mounting member 42 to the tilting seat 41.

The engagement member 43 has an upper end portion mounted rotatably on the upper end portion of the mounting member 42 by a pin 425 extending through the holes 422 of the mounting member 42, and a lower end portion formed with a projection 430 projecting therefrom into a selected one of the slots 400 of the slot element 40. A tongue 431 projects rearward from the engagement member 43 so as to sleeve the spring 45 thereon between the engagement member 43 and the mounting member 42, thereby pushing the projection 430 of the engagement member 43 to turn forward and ensuring engagement of the projection 430 with the selected one of the slots 400.

Figure 4:
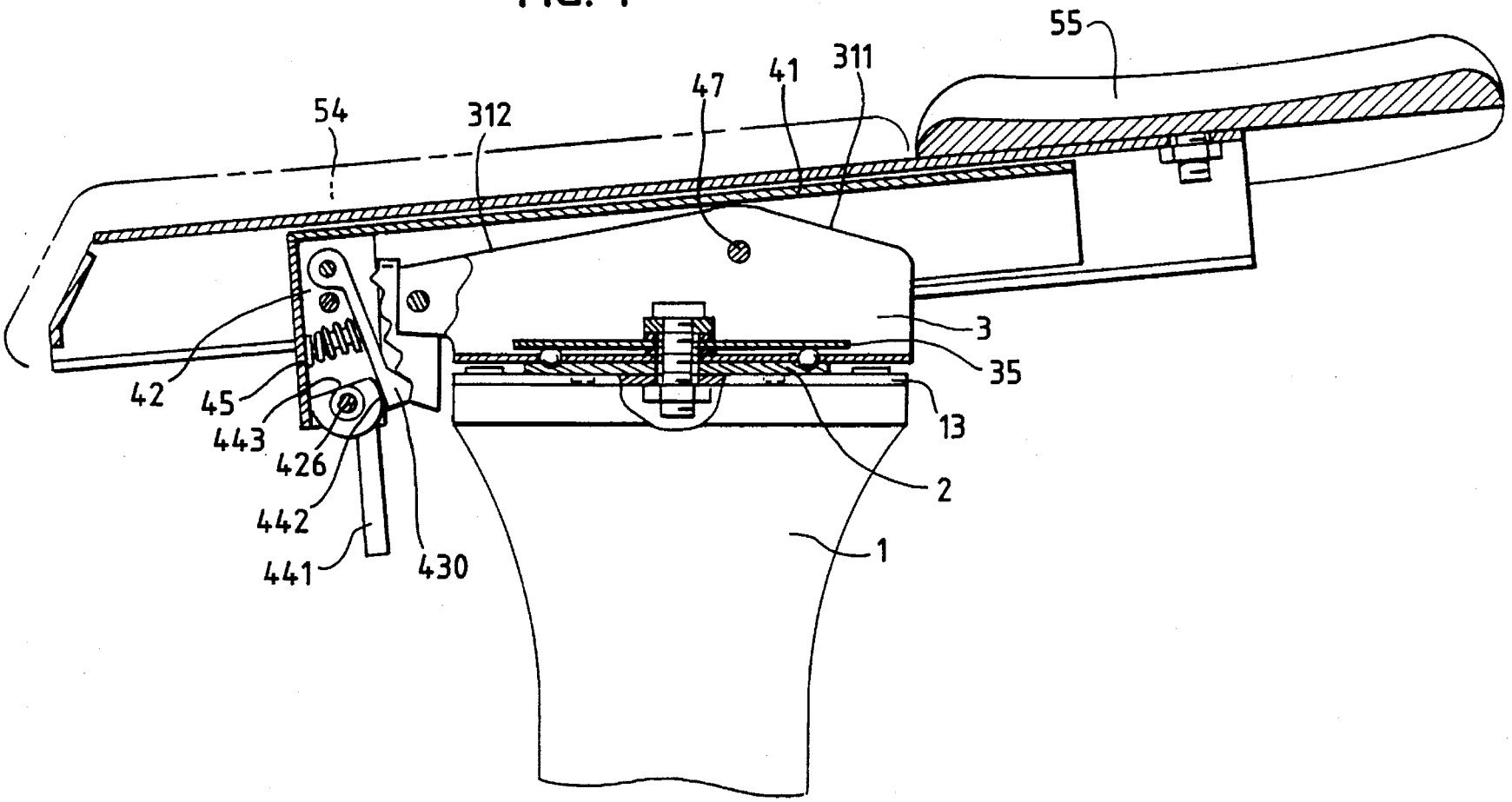
FIG. 4 is a schematic view illustrating how a wrist receiving element is turned upward relative to a positioning plate of the adjustable chair-armrest assembly in accordance with this invention.

The pusher member 44 has a pushing portion 440 pivoted to the lower end portion of the mounting member 44 at the center of the pushing portion 440 by a horizontal pivot pin 426 extending through the holes 424 of the mounting member 44, and a rotary lever 441 being integrally formed with and extending downward from the pushing portion 440. The pushing portion 440 has a curved circumferentially extending peripheral surface 442 and a flat peripheral surface 443 having two opposite sides connected to the curved circumferentially extending peripheral surface 442. The circumferentially extending peripheral surface 442 contacts the engagement member 43 so as to push the projection 430 of the engagement member 43 to engage the selected one of the slots 400 of the slot element 40. The rotary lever 441 can be rotated to remove the circumferentially extending peripheral surface 442 from the engagement member 43 so as to face the flat peripheral surface 443 toward the projection 430 of the engagement member 43 and toward the rearward surface of the slot element 40, thereby permitting the tilting seat 41 to be rotated forcibly about a horizontal axis relative to the coupling seat 3. In this way, when an upward force is applied to the wrist receiving element 55 to turn the same upward to the position shown in FIG. 4, the projection 430 of the engagement member 43 can be moved downward from one of the slots 400 of the slot element 40 into another one of the slots 400, so as to vary the inclination angle of the member 5.

Figure 5:
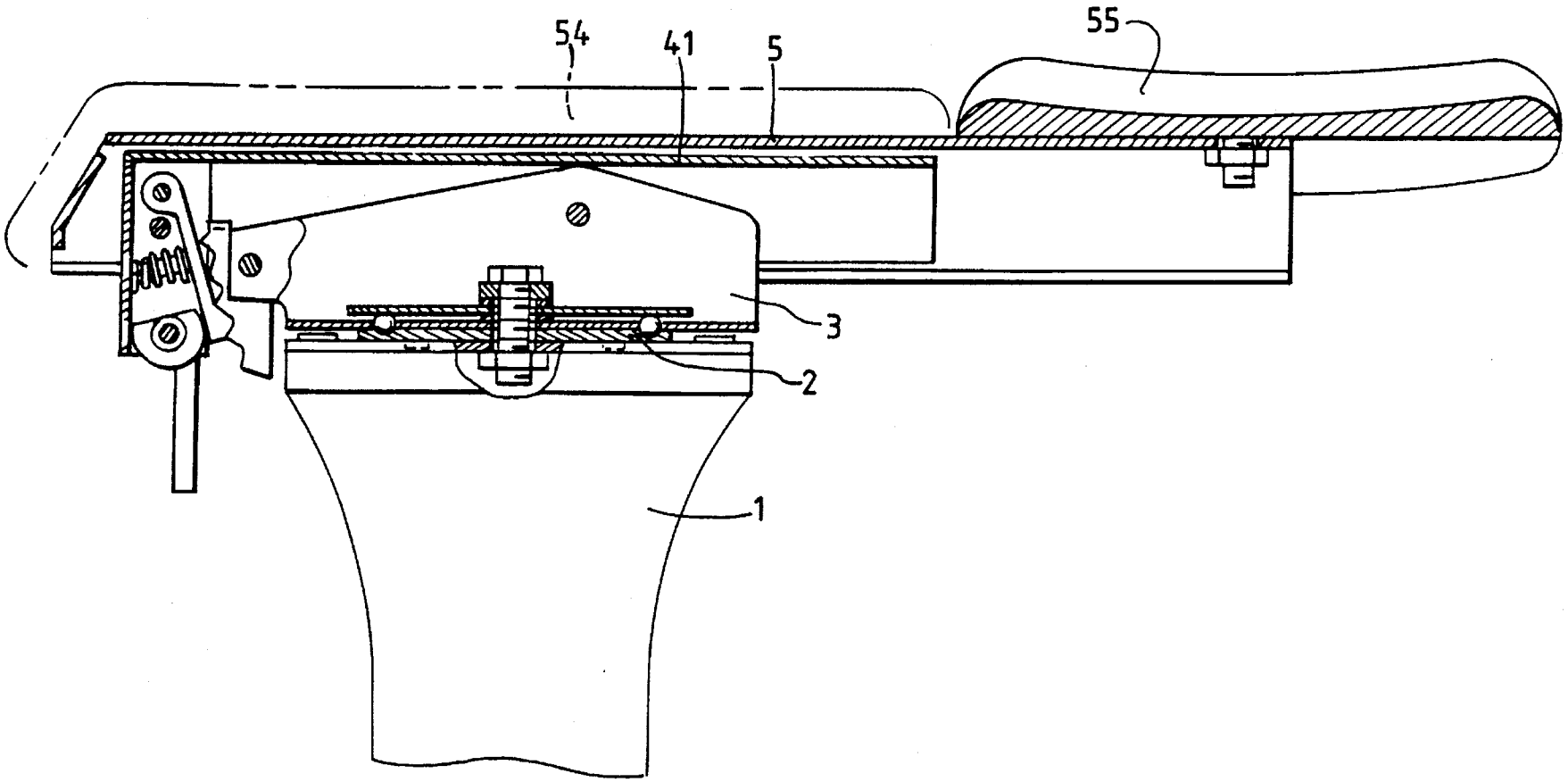
FIG. 5 is a schematic view illustrating how the armrest member is moved forward on a tilting seat of the adjustable chair-armrest assembly in accordance with this invention.

In use, as illustrated in FIG. 5, if necessary, the armrest member 5 can be moved forward or rearward along the length of the tilting seat 41.

Figure 6:
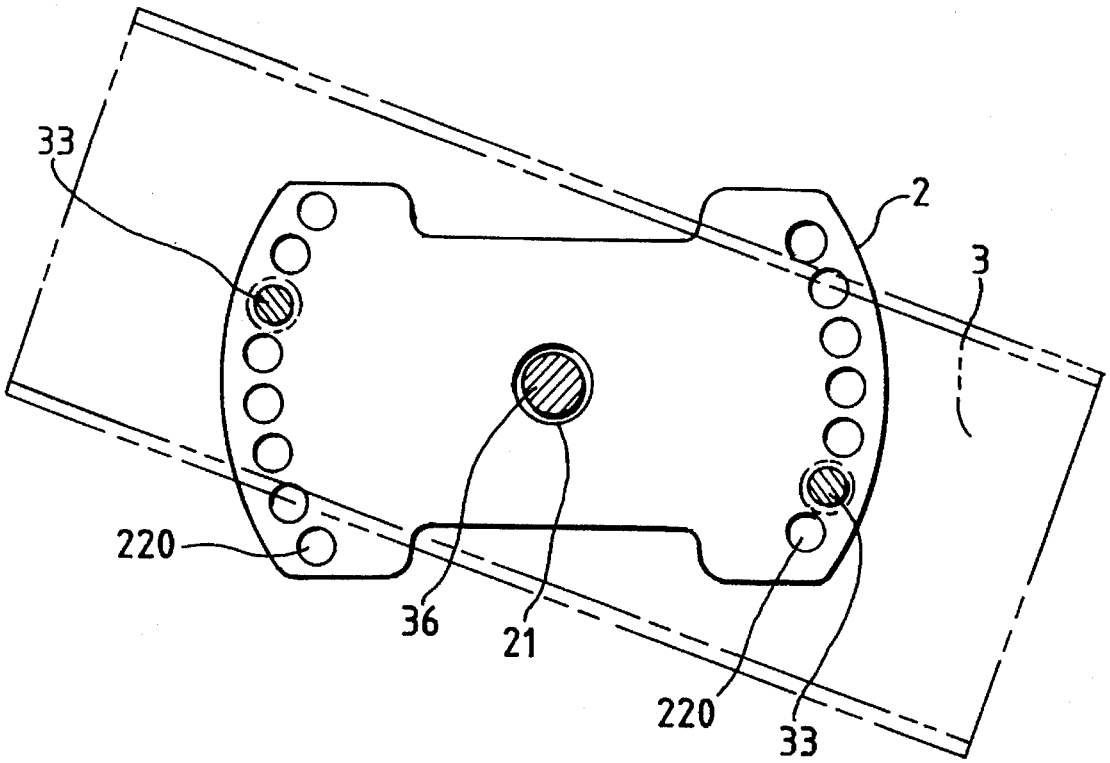
FIG. 6 is a schematic view illustrating how a coupling seat is rotated about a vertical axis on the positioning plate of the adjustable chair-armrest assembly in accordance with this invention.

As illustrated in FIG. 6, when desired, the balls 33 of the coupling seat 3 can be moved from two of the positioning holes 220 of the positioning plate 2 into another two of the positioning holes 220 so as to rotate the coupling seat 3 about a vertical axis on the positioning plate 2, thereby turning the wrist receiving element 55 to the left or right.

With this invention thus explained, it is apparent that numerous modifications and variations can be made without departing from the scope and spirit of this invention. It is therefore intended that this invention be limited only as indicated in the appended claims.

I claim:

1. An adjustable chair-armrest assembly comprising:

an elongated coupling seat adapted to be attached to a chair seat and having a front end portion and a rear end portion;

an elongated tilting seat mounted pivotally on said coupling seat and rotatable about a horizontal axis, said tilting seat having a front end portion and a rear end portion;

an elongated armrest member mounted movably over said tilting seat and movable along the length of said tilting seat, in such a manner that said armrest member is in frictional contact with said tilting seat, said armrest member including a wrist receiving element attached to the front end portion of said tilting seat; and an inclination adjusting device including:

a slot element which is fastened to the rear end portion of said coupling seat and which has a rearward surface formed with several horizontal slots extending in a direction transverse to said coupling seat;

an engagement member having an upper end portion pivoted to the rear end portion of said tilting seat, and a lower end portion provided with a projection protruding therefrom to engage a selected one of said slots in said slot element so as to determine an inclination angle of said armrest member relative to said coupling seat, a spring biasing said projection of said engagement member to abut against said rearward surface of said slot element so as to engage said projection with the selected one of said slots; and a pusher member mounted operatively on the rear end portion of said tilting seat so as to push said projection of said engagement member toward said rearward surface of said slot element, thereby engaging said projection within the selected one of said slots of said slot element, said pusher member being capable of being operated so that said projection can be moved forcibly from the selected one of said slots into another one of said slots when a force is applied to said armrest member in order to turn said wrist receiving element upward and downward.

2. An adjustable chair-armrest assembly as claimed in claim 1, wherein said tilting seat has two vertical side walls and a horizontal top wall having two sides respectively and integrally formed with upper ends of said side walls, said inclination adjustment device further including a generally U-shaped mounting member having a vertical back wall perpendicular to said side walls of said tilting seat, and two vertical side walls respectively and integrally formed with two sides of said back wall and having top sides abutting on said top wall of said tilting seat, each of said side walls of said tilting seat and said mounting member having a pivot hole formed therethrough, said inclination adjustment device further including a horizontal pivot pin extending through said pivot holes of said tilting seat and said mounting member so as to secure said mounting member to said tilting seat, said upper end portion of said engagement member being pivoted to an upper end portion of said mounting member, said pusher member having a pushing portion pivoted to a lower end portion of said mounting member at a center of said pushing portion, and a rotary lever being integrally formed with and extending downward from said pushing portion, said pushing portion having a curved circumferentially extending peripheral surface and a flat peripheral surface having two opposite sides connected to said curved circumferentially extending peripheral surface, said circumferentially extending peripheral surface contacting said engagement member so as to push said projection of said engagement member to engage the selected one of said slots of said slot element, said rotary lever being capable of being rotated to remove said circumferentially extending peripheral surface from said engagement member so as to face said flat peripheral surface toward said projection of said engagement member, thereby permitting said tilting seat to rotate about said horizontal axis relative to said coupling seat.

3. An adjustable chair-armrest assembly as claimed in claim 1, wherein an elongated positioning plate is adapted to be attached to the chair seat and has a pivot hole formed therethrough, and several equidistant positioning holes which are formed in a top surface of said positioning plate and which are all spaced apart from said pivot hole of said positioning plate at a predetermined distance, said coupling seat having a bottom wall which includes a pivot hole formed therethrough, a vertical pivot pin extending through said pivot holes of said positioning plate and said bottom wall so that said coupling seat can rotate about said pivot pin on said positioning plate, and a ball biased to engage a selected one of said positioning holes of said positioning plate, said coupling seat being capable of being rotated relative to said positioning plate so as to move said ball from the selected one of said positioning holes into another one of said positioning holes, thereby rotating said coupling seat on said positioning plate.

4. An adjustable chair-armrest assembly as claimed in claim 1, wherein said coupling seat has two aligned vertical side walls with inverted V-shaped top edges on which a bottom surface of said top wall of said tilting seat abuts, said tilting seat further having two vertical side walls with top ends which are integral with said top wall of said tilting seat in such a manner that said coupling seat is located between said side walls of said tilting seat, so that said tilting seat can swing in said coupling seat by turning said wrist receiving element of said armrest member upward and downward.

* * * * *